US005556201A

United States Patent [19]

Veltrop et al.

[11] Patent Number: 5,556,201

[45] Date of Patent: Sep. 17, 1996

[54] BOWL SCRAPER FOR COMMERCIAL OR INDUSTRIAL SIZE FOOD MIXERS

[75] Inventors: Loren Veltrop, Deerfield; Joel G. Friedl, Bloomingdale, both of Ill.

[73] Assignee: Middleby Marshall Inc., Elgin, Ill.

[21] Appl. No.: 505,747

[22] Filed: Jul. 21, 1995

[51] Int. Cl.[6] ..... B01F 7/30

[52] U.S. Cl. ..... 366/203; 366/288; 366/312

[58] Field of Search ..... 366/67, 96–98, 366/197, 198, 203, 207, 288, 309, 312, 313; 99/348

[56] References Cited

U.S. PATENT DOCUMENTS

| | | | |
|---|---|---|---|
| 370,335 | 9/1887 | Hunter | 366/288 |
| 1,415,735 | 5/1922 | Trust | 366/309 X |
| 1,674,903 | 6/1928 | Johnston et al. | 366/288 |
| 1,872,004 | 8/1932 | Rataiczak et al. | 366/309 |
| 2,574,391 | 11/1951 | Herrly | 366/309 X |
| 2,651,582 | 9/1953 | Courtney | 366/309 X |
| 4,311,397 | 1/1982 | Wright | 366/309 X |
| 4,380,398 | 4/1983 | Burgess | 366/309 X |
| 4,946,285 | 8/1990 | Vennemeyer | 366/288 |

FOREIGN PATENT DOCUMENTS

| | | | |
|---|---|---|---|
| 635177 | 9/1936 | Germany | 366/288 |
| 284910 | 1/1971 | U.S.S.R. | 366/207 |
| 1063355 | 12/1983 | U.S.S.R. | 366/197 |
| 246926 | 2/1926 | United Kingdom | 366/309 |

*Primary Examiner*—Charles E. Cooley
*Attorney, Agent, or Firm*—Laff, Whitesel, Conte & Saret, Ltd.

[57] ABSTRACT

A bowl scraper for an industrial size mixer has a bar shaped mandrel with a horizontal section and a vertical section. The horizontal section has a quick connect/disconnect coupler affixed thereto. A gravity actuator/keeper locks the mandrel in place while the mixer is operating. The vertical section is shaped to complement the shape of the interior wall of the bowl. A rubber boot, which fits over the vertical section, is adapted to scrape the bowl regardless of the direction in which the mixer turns.

11 Claims, 3 Drawing Sheets

BOWL SCRAPER FOR COMMERCIAL OR INDUSTRIAL SIZE FOOD MIXERS

This invention relates to commercial or industrial size food mixers and more particularly to means for and methods of insuring a uniform mixing of ingredients, in the proper ratio, by scraping ingredients off the inside wall of a bowl while the mixer is running.

BACKGROUND

There are many types of food mixers ranging from small hand held appliances to very large mixers (three to six feet tall) for commercial use. In any of these mixers, some of the ingredients may cling to the inside wall of the mixing bowl so that the final product is improperly mixed or does not have the correct ratio of ingredients mixed uniformly throughout the product.

In the smaller mixers that may be used in the home, for example, it is simple to use a spoon or the like in order to scrape away the ingredients clinging to the wall while the mixer is running. If the spoon is caught in the mixer blades, the only likely effect would be to produce some noise.

However, in the large commercial or industrial size food mixers that may be used in bakeries, restaurants, food processors or the like, the problem is not so easy to solve. For one thing, the commercial size mixers are powerful enough to seriously injure a person, perhaps even tearing an arm or hand from the body if a hand or sleeve is caught in the mixer tool. Therefore, this class of mixer usually has a guard in the form of a basket of heavy steel bars surrounding the access area so that no one can put his hand in or too close to the mixing bowl while the mixer is running. Such a guard basket is described in a copending U.S. patent application, Ser. No. 08/444,549, filed May. 19, 1995, and assigned to the Middleby Marshall Company of Elgin, Ill.

Another problem is that the bowl is so large that a person cannot comfortably and manually scrape the internal bowl wall while the mixer is running. This is especially true if the mixer bowl must be scraped continuously over a relatively long period of time.

Still another problem is that industrial size mixers do not always operate in the same direction. Some mixers rotate clockwise and other mixers rotate counterclockwise. However, it would be expensive and counter-productive if it is necessary to provide different bowl scrapers for each direction of operation.

Yet another problem relates to clean up. The invention uses a rubber scraper blade mounted on a stainless steel mandrel. Depending upon a number of things such as size, closeness of fit, etc., it may be desirable to place either the entire unit or the rubber scraper in a dishwasher in order to clean up. This, in turn, introduces problems of providing a scraper with a rubber boot reliably secured in place, while still enabling a quick connect or disconnect as the scraper is installed or removed.

SUMMARY OF THE INVENTION

Accordingly, an object of the invention is to provide new and improved bowl scrapers for commercial or industrial size mixers. Here an object is to provide a bowl scraper having a generic design which fits substantially all industrial mixers with little more than changes in shape or size of an arm on the scraper. In this connection, an object is to provide a quick connect/disconnect feature which facilitates the clean up after the mixing is completed.

A further object of the invention is to provide a low cost bowl scraper which, nevertheless, has a high quality performance.

In keeping with an aspect of the invention, these and other objects are accomplished by a stainless steel mandrel having an arm shaped to fit against the inside wall of the mixing bowl. An elastomer boot slides over the mandrel. The boot has scraping edges on each side so that it may provide the desired bowl scraping function regardless of the direction of rotation. A quick connect/disconnect coupler involves a pin which drops under gravity to positively lock the bowl scraper in position.

BRIEF DESCRIPTION OF THE DRAWINGS

A preferred embodiment is shown in the attached drawings, in which.

DETAILED DESCRIPTION OF THE INVENTION

Figure 2:
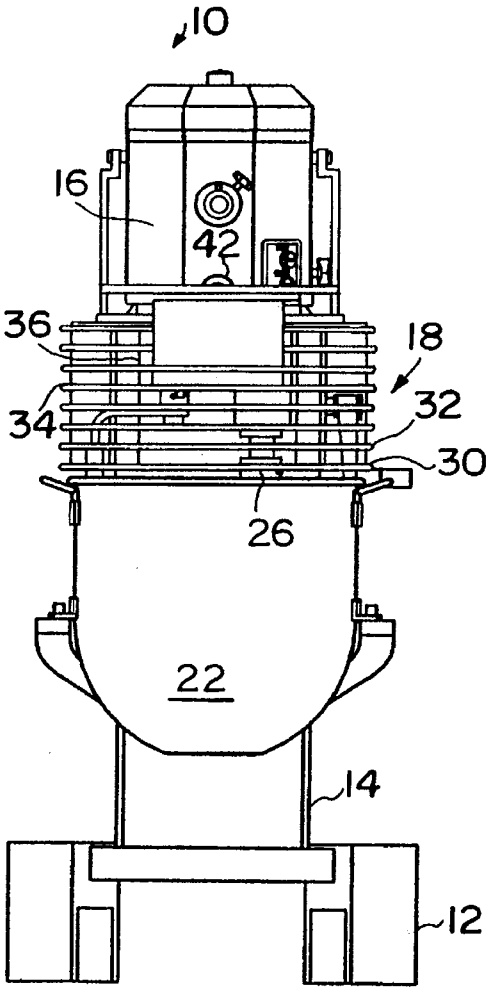
FIG. 2 is a front view of the mixer shown in FIG. 1.
Figure 1:
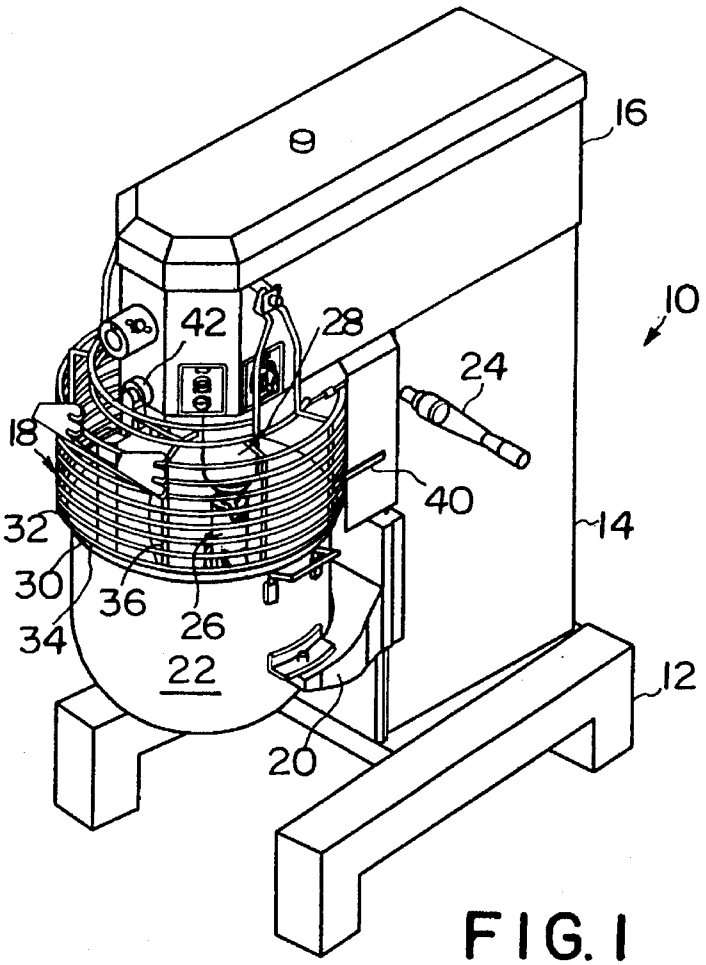
FIG. 1 is a perspective view of an industrial mixer of an industrial type, which may use the invention.

The major parts of the inventive mixer 10 (FIGS. 1 and 2) are a support 12, a housing body 14, a super structure 16, and guard basket 18. The support 12 may take any suitable form provided that it is large enough to give stability to a machine which might be about as tall as a person who may use it, for example.

The body 14 includes an elevator mechanism having a bowl support fork 20 for receiving a mixing bowl 22 which may be lifted off or set on the fork. Bowl 22 simply rests under gravity while it is on the fork 20. A crank 24 raises or lowers the fork 20. Therefore, to install or remove a mixing bowl, the crank 24 is turned to lower the bowl support fork 20 far enough so that the bowl 22 may be put into place or removed with the scraper and mixing tool 26 still attached to the mixer. Thereafter, the crank 24 is turned and fork 20 raises the bowl 22 into an operative position where scraper and mixing tool 26 clean the bowl and stir any ingredients that may be in the bowl.

A motor and any other suitable drive may be located at any suitable place within either the housing 14 or super structure 16. When the motor is running, a planetary rotary member 28 (FIG. 3) turns about a center axis. The mixing tool 26 (FIGS. 4, 5), which is mounted off center on planetary rotary member 28, moves with the rotary member, orbiting about its center axis 29. As it so orbits, the mixing tool stirs the ingredients in the mixing bowl 22. The mixing tool 26 may be made in any of many suitable forms, which may be selected and changed as needed.

The guard 18 is a basket-like member made of suitable material such as stainless steel bars about 3/16 to 1/4-inches in diameter which are welded together to form a grid that surrounds and encloses all open space through which a person might reach into the bowl 22. A number of these bars (such as 30, 32) are bent into an arcuate shape, encircling and enclosing any open space which is large enough for a person to be injured if he or his clothing is struck or caught by the orbiting scraper and blade. These arcuate bars are held in a spaced parallel relationship by a series of vertical bars, such as 34, 36. A side guide 40 on the side of the mixer closes space between and fixes the relative positions of the guard basket 18 and the housing body 14. The side guide 40 forces the basket 18 into a position which prevents any one from reaching around behind the guard basket in order to put their hand into bowl 22.

A proximity sensor 42 is positioned on the mixer adjacent a tab welded to the guard basket. The tab is arranged to confront an inductively controlled contact in sensor 42 which closes an electrical circuit to enable an operation of the mixer, if the guard basket 16 is firmly and properly in place. If the guard basket is moved out of its position, the tab moves away from sensor 42 and the inductively controlled contacts open to stop the machine.

Figures 3, 4, 5:
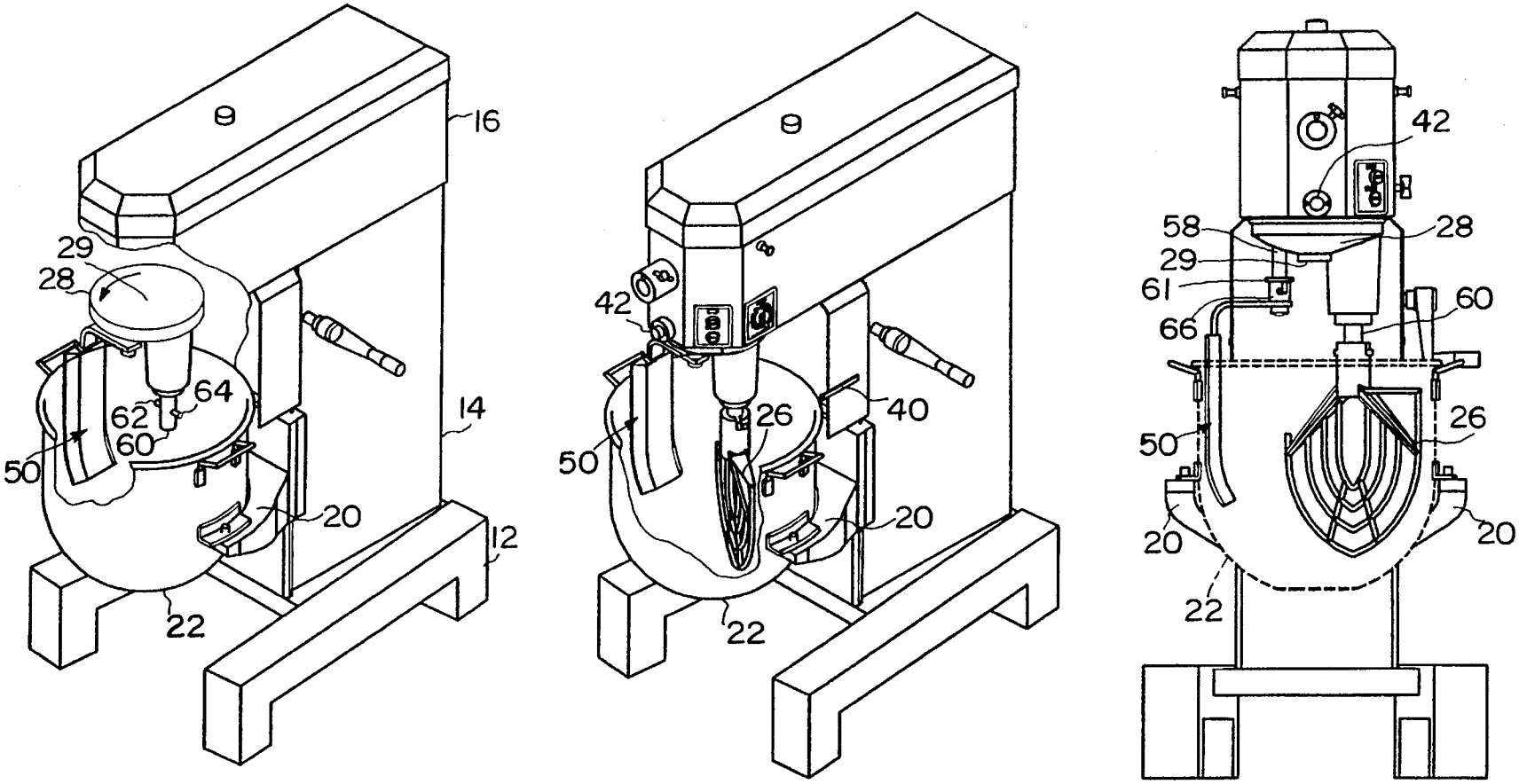
FIGS. 3 and 4 are similar to FIG. 1, but with parts of a mixer housing and bowl broken away to show the inventive bowl scraper, with and without the mixing tool in place.
FIG. 5 is a front view with the bowl shown in phantom lines to reveal the scraper and mixing tool.

The inventive bowl scraper 50 is shown in connection with and mounted on the mixer in FIGS. 3–5. The planetary rotary member or drive 28 is arranged to rotate about its central axis 29. Peripherally mounted on the planetary drive 52, at diagonally displaced positions and away from the central axis 29, are a mixing tool 26 and the inventive bowl scraper 50. Therefore, as the planetary rotary member 28 rotates, the tool 26 and scraper 50 orbit inside the bowl 22. The scraper 50 rubs against the inside wall of the bowl cleaning away the ingredients clinging to the side of the bowl so that there is a uniform mixing by tool 26. Also, the scraper insures a proper ratio of ingredients so that the final product does not end up with, say, a cup full of flour still clinging to the inside bowl wall and thus extracted from the recipe.

Either or both the mixing tool 26 or the bowl scraper 50 may be removed quickly and easily while insuring against an accidental disconnect during an operation of the mixer. To prevent an accidental interchange of scraper and mixing tool, they are mounted on shafts 58, 60 (FIG. 5) of different diameters.

A bayonet quick connect/disconnect connector 61 is best seen and described in FIGS. 3, 5 and 6–9. Two oppositely disposed pins 62, 64 (FIG. 3) extend horizontally from each of the shafts 58, 60. Both the tool 26 and scraper 50 have a socket 66 (FIG. 6) affixed thereon with two oppositely disposed "L" shaped slots 68, 70 formed therein. A locking keeper 72 (FIG. 7) comprises a ring 74 having a pin 76 dependent therefrom. The ring has a central aperture 78 which slips fairly loosely over the shafts 58 or 60 so that the ring may slide freely up or down on the shafts. The pins 62, 64, 76 and the L-shape slots 68, 70 have mutual dimensions so that the pins fit easily into the slots 68, 70.

Figure 8:
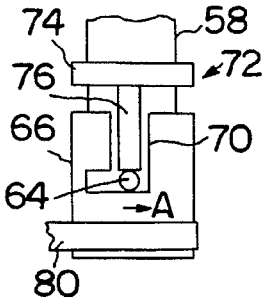
FIG. 8 is a side elevation of the quick connect/disconnect coupler in an unlocked condition.
Figure 9:
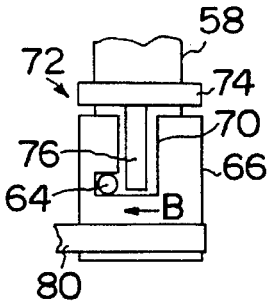
FIG. 9 is a similar view of the coupler in a locked condition.
Figure 7:
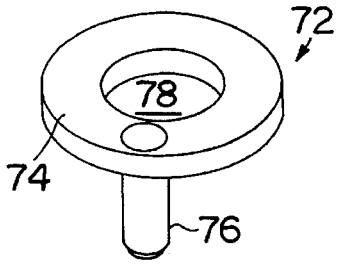
FIG. 7 is a perspective view of a part for a quick connect/disconnect locking keeper.

In order to install the scraper 50 or tool 26, the ring 74 is raised and rotated to stand on top of the pin 62 or 64 (FIG. 8). When in this position, the socket 66 may be placed over and slipped up the end of shaft 58 and then rotated in direction A. The toe of the L-shaped slot 70 moves over pin 64 fixed to the shaft 58 (FIG. 9). On the opposite side of the shaft 58 (not visible in FIG. 9), the pin 62 moves into the toe of the L-shaped slot 68. When this happens, the pin 76 drops through the vertical part of the L-shaped slot 70, thereby trapping pin 64 (or 62) in the toe of the "L", as seen in FIG. 9. The scraper 50 or tool 56 is now locked in position and cannot thereafter be removed from the shaft since the pin 76, in the lower position shown in FIG. 9, blocks movement of pin 64 out of the toe of the "L".

To remove the scraper 50 or tool 56 from the associated shaft 58, 60, ring 74 is slid up the shaft far enough to enable an escape of pin 64 from the toe of L-shaped slot 70. Socket 66 is rotated in direction B (FIG. 9), thus returning to a position where the pin 64 is in alignment with pin 76 and in the condition shown in FIG. 8. The scraper 50 or tool 56 may then be pulled down and off the end of its individually associated shaft 58 or 60, respectively.

Figure 6:
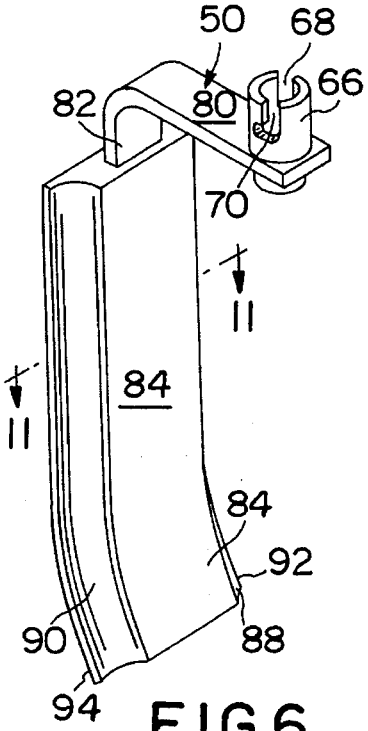
FIG. 6 is a perspective view of the bowl scraper, per se.
Figure 10:
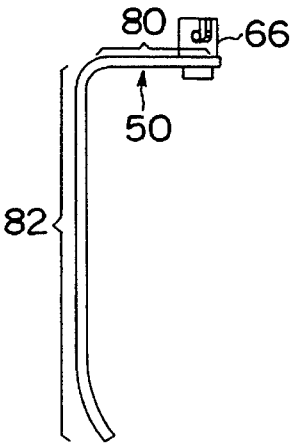
FIG. 10 is a side elevation of a mandrel for the inventive bowl scraper.
Figure 11:
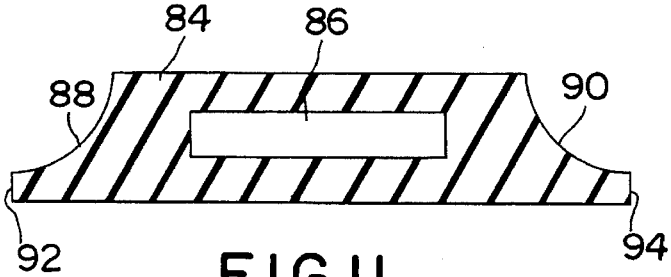
FIG. 11 is a cross section of an elastomeric boot, taken along line 11—11 of FIG. 6, which fits on the mandrel of FIG. 10.

The construction of bowl scraper 50 should become more apparent from a study of FIGS. 6, 10, and 11. A mandrel is a stainless steel bar having a horizontal section 80 attached to and supporting the socket 66. A generally vertical arm or section 82 of the mandrel is shaped to match the contour of the inside wall of bowl 22.

A suitable elongated elastomer boot 84 contains a central void or opening 86 (FIG. 11) having a cross section corresponding to the cross section of the vertical arm or section 82 of the scraper 50 mandrel. Preferably, boot 84 is made of rubber. The relative cross section dimensions of void 86 and mandrel section 82 are such that the boot 84 may slide onto and off of section 82 fairly easily. However, the fit is also snug enough so that the boot 84 will not come off vertical arm or section 82 during normal operation of the mixer. Moreover, since vertical section 82 and the inside of the bowl 22 have a complementary shape with the bottom of the scraper and bowl curving inwardly, the bottom of the bowl tends to support the boot and to hold it in place on the mandrel of FIG. 10 during the operation of the mixer.

The opposite edges of the elastomeric boot 84 have vertical scraping edges 92, 94 which are pressed against the bowl by a generally concave shape 88, 90. Hence, the scraping effect is the same regardless of the direction in which the mixer turns. The flexibility of the elastomeric and the relative resilience resulting from the tapering of the concave shape 88, 90 causes the scraping edges 92, 94 to be held in intimate and scraping contact with the inside wall of the bowl.

Of course, there may be times when it is desirable to have the bowl scraper perform some function other than or in addition to that described above. For example, it may be desirable to aerate a mixture as it is being mixed in the bowl 22, in which case, the boot 84 may be arranged to deliver air into the mixture. More particularly, pressurized air is delivered through shaft 58 and into passageways and out perforations (not shown) in boot 84 into the mixture in bowl 22. Therefore, the principles described above may be adapted to serve not only scraping, but also any comparable needs.

Those who are skilled in the art will readily perceive how to modify the invention. Therefore, the appended claims are to be construed to cover all equivalent structures which fall within the true scope and spirit of the invention.

The invention claimed is:

1. A bowl scraper for an industrial size mixer, said scraper comprising a mandrel having a horizontal section with a connector affixed thereto and a vertical section shaped to conform to interior wall contours of a bowl, an elongated elastomeric boot having a central void extending through substantially a length thereof, said vertical section of said mandrel and said void having substantially the same cross sectional shape and size so that said elastomeric boot slips on to and off of said vertical section of said mandrel with enough friction to hold said boot in place when on said mandrel, said connector comprising a socket having at least one L-shaped slot therein, a shaft on said mixer having at least one horizontally disposed pin extending therefrom, said at least one horizontal pin having dimensions enabling it to enter said L-shaped slot when said socket is fitted over the end of and pushed up said shaft, a ring slidably fitted over said shaft at a position above said at least one horizontal pin, a vertical pin dependent from said ring and dimensioned to fit into said L-shaped slot when said vertical pin is aligned with said at least one horizontal pin, said vertical pin falling through a vertical part of said L-shaped slot to trap said at least one horizontal pin in a toe of said L-shaped slot when said socket is rotated while on said shaft.

2. The bowl scraper of claim 1 wherein opposite sides of said boot have scraping edges so that an edge scrapes the interior wall of the bowl regardless of the direction in which said mixer turns.

3. The bowl scraper of claim 2 wherein said opposite sides of said boot have a tapered contour with a shape providing a resilience that presses said scraping edge against the interior wall of said bowl.

4. The bowl scraper of claim 1 wherein there are two L-shaped slots in said socket and two horizontal pins on said shaft, said slots and horizontal pins being diametrically opposed in said socket and on said shaft.

5. A bowl scraper for an industrial mixer having a planetary rotary member with a pair of oppositely disposed dependent shafts displaced from a central axis about which said planetary member rotates, whereby said pair of shafts orbit said central axis as said planetary member rotates, a mixing tool attached to one of said shafts and a scraper attached to the other of said shafts, said bowl scraper comprising a mandrel having an elastomeric boot thereon, said boot having a shape which scrapes an interior wall of a bowl while said mandrel orbits said central axis, and a quick connect/disconnect connector on said scraper, said connector comprising a socket which fits onto a bottom end of said other shaft, said connector having a gravity actuated keeper which falls into place to lock said socket to said shaft when said socket is in place on the bottom of said other shaft.

6. The bowl scraper of claim 5 wherein said connector is said socket having oppositely disposed L-shaped slots formed therein, at least said other shaft on said mixer having opposite horizontally disposed pins extending therefrom, said horizontal pins having dimensions enabling them to enter said L-shaped slots when said socket is fitted over the end of and pushed up onto said other shaft, a ring slidably fitted over said other shaft at a position above said horizontal pins, a vertical pin dependent from said ring and dimensioned to fit into a vertical section of one of said L-shaped slots when said vertical pin is aligned with one of said horizontal pins, said vertical pin falling through said vertical section of said one L-shaped slot to trap said one horizontal pin in a toe of said one L-shaped slot when said socket is rotated while on said other shaft.

7. The bowl scraper of claim 5 wherein said pair of oppositely disposed shafts have different diameters and said tool and scraper have quick connect/disconnect connectors of complementary diameters.

8. An industrial size mixer comprising a housing having an elevator mechanism thereon for raising or lowering a bowl, a planetary rotary member positioned above said bowl, said planetary rotary member turning about a central axis, a bowl scraper and a mixing tool dependent from diametrically opposed points on said rotary member, said diametrically opposed points being displaced from said central axis of said rotary member whereby said scraper and tool orbit said central axis as said rotary member turns, said scraper having a vertical shape which scrapes an internal wall of said bowl when said bowl is in a raised position and said rotary member is turning, said planetary rotary member having two dependent shafts of different diameters, said bowl scraper having a first socket fitting over an associated one of said two shafts and said mixing tool having a second socket fitting over and associated with the other of said two shafts whereby said bowl scraper and said mixing tool cannot be put on the wrong shaft, each of said sockets having oppositely disposed L-shaped slots formed therein, each of said shafts on said mixer having oppositely disposed horizontal pins extending therefrom, said horizontal pins having dimensions enabling them to enter said L-shaped slots when the socket associated with the shaft having the horizontal pin is fitted over the end of and pushed up on the shaft that is associated with the socket, a ring slidably fitted over each of said shafts at a position above said horizontal pins on that shaft, a vertical pin dependent from each of said rings, each of said vertical pins being dimensioned to fit into a vertical part of said L-shaped slot on an associated socket when said vertical pin is aligned with one of said horizontal pins, said vertical pin falling through said vertical part of said L-shaped slot of said associated socket to trap said one horizontal pin in a toe of said L-shaped slot when said socket is rotated while on said associated shaft.

9. The mixer of claim 8 wherein said scraper comprising a mandrel having a horizontal section with said socket affixed thereto and a vertical section shaped to conform to internal contours of the bowl, an elongated elastomeric boot having a central void extending through at least part of a length thereof, said vertical section of said mandrel and said void having substantially the same cross sectional shape and size so that said mandrel slips on to and off of said vertical section with enough friction to hold said boot in place when on said mandrel.

10. The bowl scraper of claim 9 wherein opposite sides of said boot have scraping edges so that an edge scrapes the sides of the bowl regardless of the direction in which said mixer turns.

11. The bowl scraper of claim 10 wherein said opposite sides of said boot have a tapered contour with a shape providing a resilience that presses said scraping edge against the interior wall of said bowl.

* * * * *